US006966310B2

(12) United States Patent
Moren

(10) Patent No.: US 6,966,310 B2
(45) Date of Patent: Nov. 22, 2005

(54) METHOD AND DEVICE FOR VENTILATION OF GASES IN A COMBUSTION ENGINE

(75) Inventor: Mats Moren, Göteborg (SE)

(73) Assignee: Volvo Personvagnar AB, Gothenburg (SE)

( * ) Notice: Subject to any disclaimer, the term of this patent is extended or adjusted under 35 U.S.C. 154(b) by 71 days.

(21) Appl. No.: 09/681,596

(22) Filed: May 3, 2001

(65) Prior Publication Data

US 2001/0042541 A1 Nov. 22, 2001

(30) Foreign Application Priority Data

May 5, 2000 (SE) ..... 0001645

(51) Int. Cl.[7] ..... F02B 47/08
(52) U.S. Cl. ..... 123/568.18; 123/516; 123/184.54
(58) Field of Search ..... 123/516, 571, 123/184.42, 184.54, 184.47, 568.18, 572; 137/855, 852; 251/368

(56) References Cited

U.S. PATENT DOCUMENTS

| | | | | |
|---|---|---|---|---|
| 4,185,604 A | * | 1/1980 | Nagaishi et al. | 123/571 |
| 4,328,781 A | | 5/1982 | Morita | |
| 4,693,226 A | | 9/1987 | Choma | |
| 4,755,110 A | * | 7/1988 | Bauer et al. | 417/364 |
| 4,764,091 A | * | 8/1988 | Ikeda et al. | 417/269 |
| 4,955,329 A | * | 9/1990 | D'Angelo et al. | 123/184.54 |
| 5,014,654 A | | 5/1991 | Ishibashi | |
| 5,406,976 A | * | 4/1995 | Bekki | 137/513.3 |
| 5,642,698 A | * | 7/1997 | Diehl et al. | 123/184.42 |
| 5,775,357 A | * | 7/1998 | Regna et al. | 137/43 |
| 5,813,375 A | | 9/1998 | Taylor | |
| 5,862,790 A | * | 1/1999 | Dai et al. | 123/316 |
| 5,937,834 A | * | 8/1999 | Oto | 123/568.18 |
| 6,009,863 A | | 1/2000 | Tochizawa | |
| 6,206,655 B1 | * | 3/2001 | Tanaka et al. | 417/312 |

FOREIGN PATENT DOCUMENTS

| | | |
|---|---|---|
| DE | 19757986 A | 7/1999 |
| EP | 0251159 A2 | 1/1988 |
| EP | 0489238 A2 | 6/1992 |
| EP | 0855502 A | 7/1998 |
| EP | 1024280 A2 | 5/2000 |
| EP | 1024280 A | 8/2000 |

* cited by examiner

*Primary Examiner*—Carl S. Miller
(74) *Attorney, Agent, or Firm*—Fitch, Eve, Tabin & Flannery

(57) ABSTRACT

Method and arrangement for distributing exhaust gases or gases which are ventilated from a crankcase or an evaporator of a combustion engine having a cylinder head (8) with intake valves and an intake manifold (3) with a flange (9) for mounting on the cylinder head. The intake manifold is provided with at least one collecting channel (11) which extends across each intake pipe of the intake manifold. The ventilation is made by sucking the gases from the collecting channel (11) directly into each intake pipe through a non-return valve (16, 17, 18, 19) arranged in connection with each intake pipe, which non-return valve is controlled by pressure pulses from the intake valves.

6 Claims, 21 Drawing Sheets

METHOD AND DEVICE FOR VENTILATION OF GASES IN A COMBUSTION ENGINE

BACKGROUND OF INVENTION

Technical Field

The invention relates to a method and a device for ventilation of gases from a crankcase, an evaporator and similar devices to the intake system of the engine where the gases are evenly distributed to all the cylinders.

It is a known fact that it is not possible to make piston ring seals between a piston and a cylinder wall in a combustion engine, which at normal running completely seals the combustion chamber from the crankcase of the engine. A certain amount of combustion gases, hereafter termed blow-by, will therefore, with few exceptions, flow past the piston rings and into the crankcase of the engine. To avoid the pressure in the crankcase rising too much, it must be ventilated in order to lead off the gases, with only a slight overpressure or negative pressure being present in the crankcase.

It is desired to ventilate the crankcase against atmospheric pressure, but for environmental reasons it is not suitable to ventilate directly to the atmosphere. In order to use the existing purification equipment of the engine, blow-by has to be returned to the combustion chamber of the engine, which is done by leading the gas to the intake manifold of the engine where it is mixed with the intake air. In spite of the fact that some kind of oil separator has been used, it has until now been unavoidable that a certain amount of oil mist has followed the blow-by gas out of the crankcase through the evacuation conduit. This mixture will in the following be termed crankcase gas.

The simplest solution is to connect an evacuation conduit from the crankcase to the intake manifold at a point after the throttle valve, but as a powerful negative pressure often exists there, especially at low load, there is a risk of creating an undesirably high negative pressure in the crankcase. A known way to solve the problem is to connect a pressure regulator between an oil separator connected to the crankcase and the intake manifold, which pressure regulator admits a flow to the intake manifold.

The disadvantages with this solution is that the intake pipe which is situated furthest away from the connection will receive a too small part of the gases which makes it difficult to achieve a correct $\lambda$ value (fuel/air mix) for all pipes. This causes a deteriorated function for a close connected catalyzer in the exhaust manifold.

Similar problems arise during evacuation of the canister of the vehicle, which is used to absorb fuel vapors from the petrol tank in order to avoid ventilation of the fuel vapors to the atmosphere. Especially during refilling of fuel and at high ambient temperatures, the canister has to absorb a relatively large amount of fuel vapors. The function of the canister is commonly known, and will not be described further. In order to avoid saturation of the canister, it has to be equipped with an evacuation conduit, which by means of low pressure sucks the vapors from the canister to the intake manifold of the engine via an air vent valve.

Another known solution is to use a separate gallery channel to distribute the crankcase gases and evaporated fuel vapors (EVAP). The disadvantage with such a solution is that the channel short-circuits the pipes of the intake manifold, whereby the pressure pulses created by the intake valves and the performance of the engine are deteriorated. In addition, it is impossible to achieve an even distribution of the gases since a certain dilution with air is unavoidable due to the pulses in the intake manifold.

A further known solution is disclosed in EP-B2-489 238, where the distribution of crankcase gases takes place via a gallery channel which in turn is connected to the injection valves of the engine. Hence, the ventilation takes place independently of the pressure in the intake manifold, but only each time that the injection valve is activated. During engine braking or when disengaging one or more cylinders, there is a risk of pressure build-up in the crankcase. Due to the small dimensions of the injection nozzle, there is also a risk for engine malfunctions if impurities in the gas creates coatings that may disturb the function of the nozzle.

SUMMARY OF THE INVENTION

A purpose of the present invention is to achieve a combustion engine with ventilation of crankcase gases from an evaporator or similar devices, thus eliminating the above-mentioned problems.

The invention relates to a method and a device for distributing gases that are ventilated from, for example the crankcase of the engine or an evaporator (canister) in the fuel system of the engine. The engine typically includes a cylinder head and an intake manifold having a flange for mounting on the cylinder head, where the flange is equipped with a collecting channel which extends across the intake pipes of the intake manifold. The gases are sucked from the collecting channel directly into each intake pipe through a non-return valve arranged in connection to each intake pipe. In this manner, the non-return valves are controlled by pressure pulses from the intake valves of the pistons instead of, according to previously disclosed solutions, being dependent on a negative pressure in the intake manifold in the proximity of the throttle. The solution may thus be used for both aspirating engines and supercharged engines, which in the latter case eliminates an extra conduit connected upstream of the supercharge unit.

As the collecting channel to which the gases are taken is connected to each intake pipe of the intake manifold via outlet channels with separate non-return valves, an even distribution of gases to all the cylinders of the engine is achieved.

The non-return valves are either mounted in the flange which is arranged on the intake manifold for mounting to the cylinder head, or alternatively directly into the part of the cylinder head facing the flange. The flange may constitute an integrated part of the intake manifold or be mounted as a separate unit between the intake manifold and the cylinder head. The non-return valves may be of standard type, for example ball valves or valves of the diaphragm-type.

According to a further embodiment, the valves may constitute a part of a gasket between the flange and the cylinder head. In this case, the valves are in the form of reed valves which are resiliently arranged against the openings or bores emerging in the collecting channel. Every reed valve may thus be formed in one piece with the gasket which is preferably made of steel, for example spring steel or some other suitable material such as fiber-based materials.

For such cases where the engine is equipped with a split intake manifold, the gallery channel and the non-return valves may be arranged in one of the flanges in the joint between the two halves of the manifold.

Except for purely mechanical valves, it is also possible to use solenoid valves which are controlled by pressure sensors in respective intake pipes, where each respective valve opens as soon as the pressure in the corresponding intake pipe is lower than a measured pressure in the collecting channel. Alternatively, actuation may be by provided from the electronic control system of the engine.

The collecting channel may be carried out as a through bore in the flange. The bore may be sealed at both of its ends, or alternatively at one of its ends with a connection for supply of gases at the other.

According to one more embodiment, the collecting channel may be made as a milled recess provided with a covering lid, with the recess being milled at the edge, front side or rear side of the flange. When the recess is placed on the front side facing the cylinder block, the covering lid is also equipped with outlet channels.

When the flange is made as a casting, it is of course also possible to make the collecting channel in connection with the casting of the flange or the intake manifold. The outlet channels can then be made in the same process, or be drilled afterwards.

If there is not enough space in the flange for a through collecting channel, it may be placed in a separate unit connected to the intake manifold.

DETAILED DESCRIPTION

Figure 1:
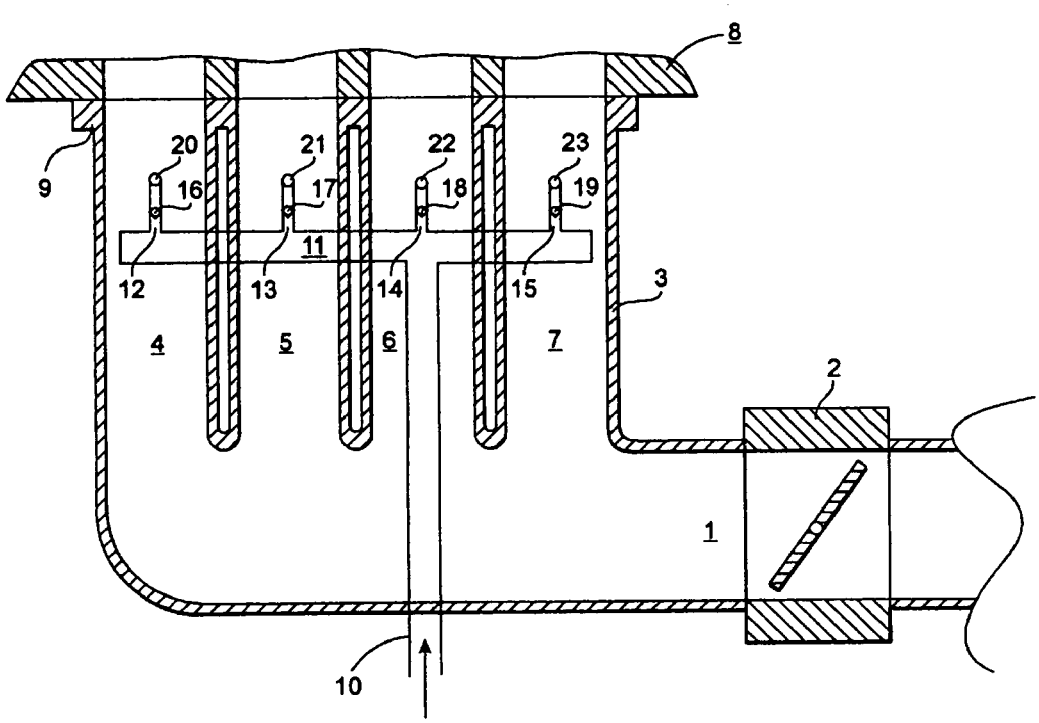
FIG. 1 is a cross-sectional view of an intake manifold with a schematic drawing of a gallery channel configured according to the invention.

Referring to the figures, FIG. 1 illustrates the principle behind the function of the present invention. An intake pipe 1 with a throttle 2 passes into an intake manifold 3 with pipes 4,5,6,7 provided, one for each cylinder. The manifold 3 is mounted on a cylinder head 8, which will not be described in detail, by means of a flange 9. Gases to be ventilated from the crankcase of the engine (PCV) and/or gas absorbing equipment (not shown), for example a canister, are guided through a ventilation conduit 10 to a so-called gallery channel 11 in connection with the manifold 3. The example shows an engine with four cylinders, but the invention is completely independent of the number of cylinders. It is also possible to re-circulate exhaust gases (EGR) in this way, but in order to avoid the tar-like coatings which may arise when exhaust fumes and crankcase gases are mixed, these gases should be kept separated as far as possible. An example of how this may be achieved is described below.

The ventilated gases are guided from the gallery channel 11 through separate conduits 12–15 with respective non-return valves 16–19 and are connected directly to their respective pipes 4–7 of the intake manifold via a corresponding number of openings 20–23. Thus, the ventilated gases are distributed evenly between all the nozzles which facilitates engine control and allows for better exhaust gas purification. The non-return valves 16–19 are opened and closed due to pressure pulses from the intake valve(s) of the respective intake pipes. When negative pressure pulses from the intake valves are used to open respective non-return valves, it is possible to become partially independent of the pressure in the intake pipe 1 so that the technical solutions may be used for both aspirating engines and supercharged engines.

Figure 2A:
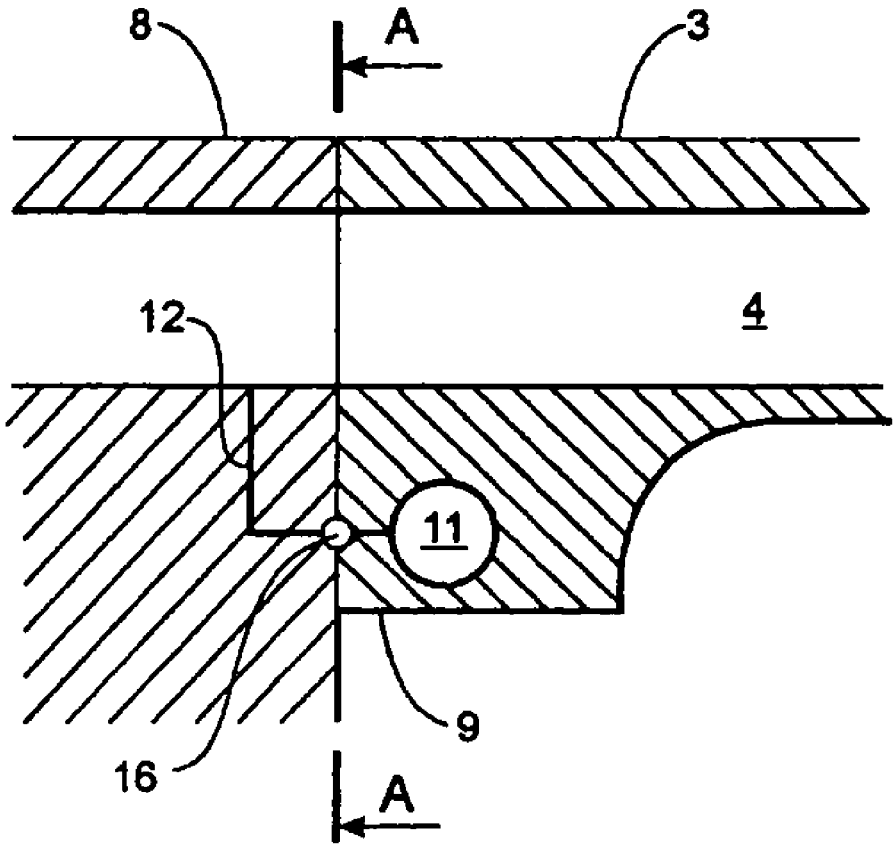
FIG. 2A-F is a schematic drawing of different possible positions of a non-return valve in the flange, the cylinder head or the manifold.
Figure 2B:
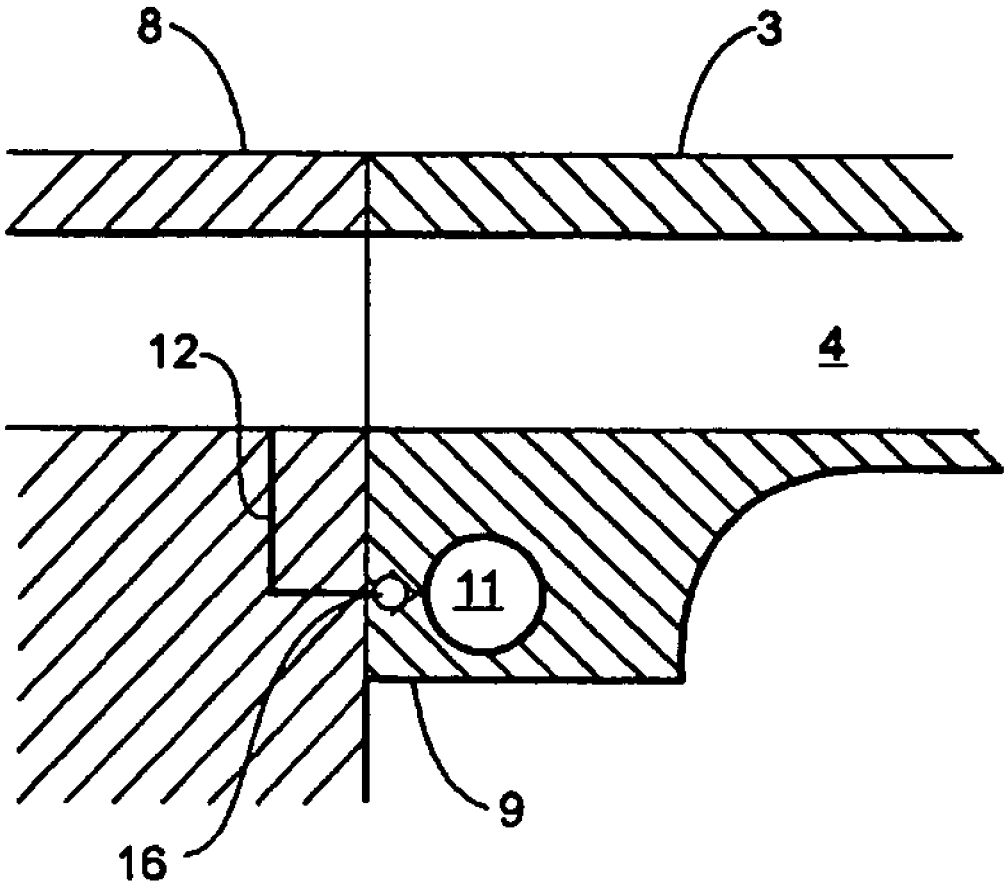
Figure 2C:
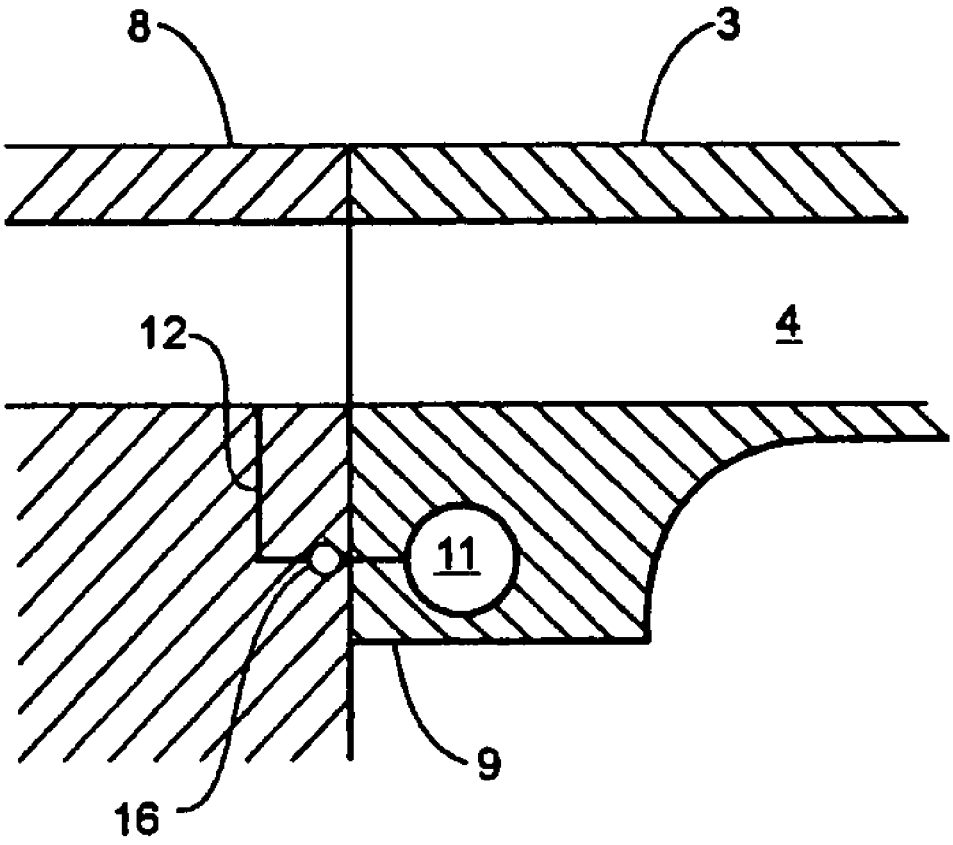

FIGS. 2A–C show schematically how the non-return valves 16–19 may be positioned. Many of the subsequent views are sectioned, which is why the reference numbers relate to one of the pipes for the sake of simplicity. In a first embodiment that is illustrated in FIG. 2A, the non-return valves are placed in the split plane A—A between cylinder head 8 and flange 9. According to a preferred, embodiment the valves are made as a part of the gasket between the cylinder head and the flange.

Figure 3A:
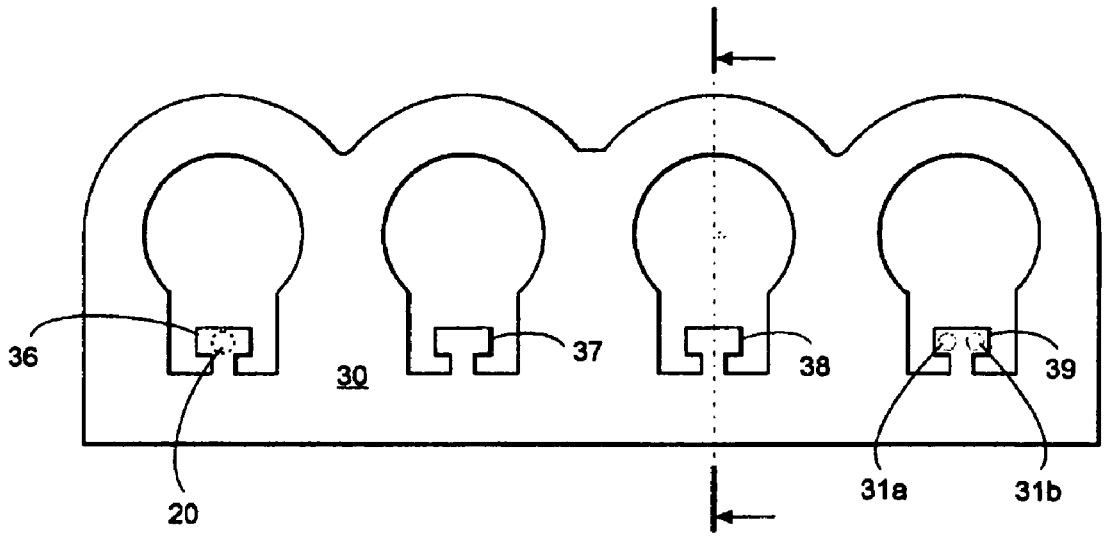
FIG. 3A is an elevational view showing the part of an intake manifold facing a cylinder, with alternative outlets for the gallery channel.
Figure 3B:
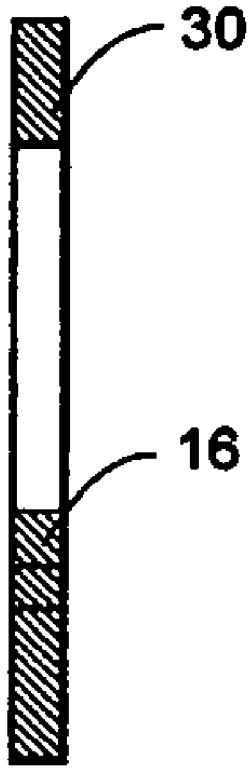
FIG. 3B is a cross-sectional view taken along the indicated bisecting line in FIG. 3A.
Figure 4:
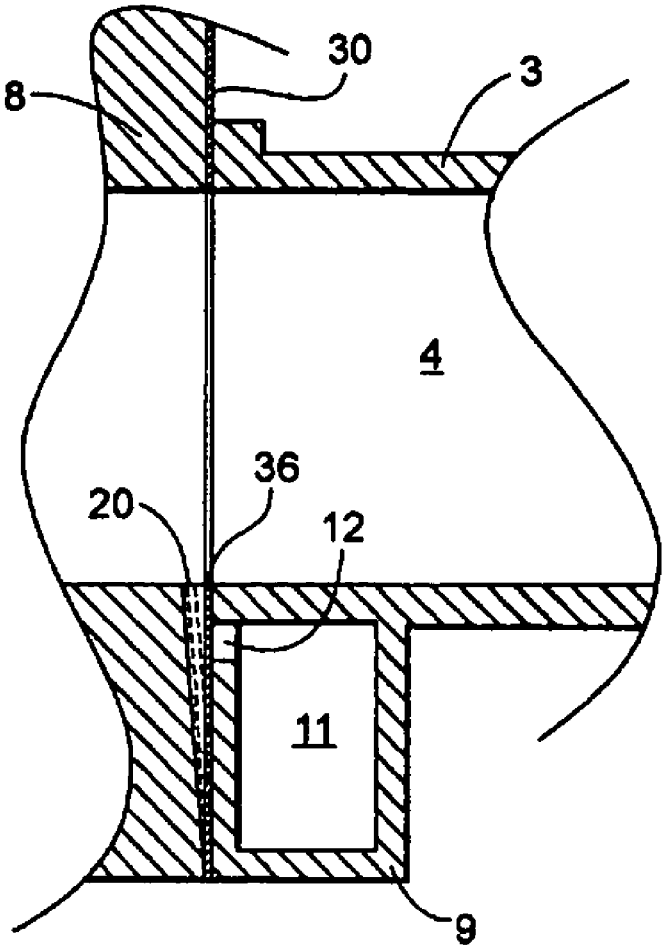
FIG. 4 is a partial cross-sectional view taken through a reed-type valve positioned between the intake manifold and the cylinder head.

The moving parts of the non-return valve can be shaped like tongues, such as reed valves, which may be punched out in one piece with the gasket. An example of such a solution is disclosed in FIG. 3, which shows a gasket 30 equipped with reed valves 36–39. The position of one of the outlet openings 20 of the gallery channel 11 is indicated for the valve 36. The function of the reed valve is evident from FIG. 4 which shows how the outlet 12 of the gallery channel 11 normally is closed by the reed valve 36 of the gasket 30. Should a negative pressure pulse occur in the pipe 4, the valve 36 will assume the position indicated with dashed lines in FIG. 4. As shown in FIGS. 2B and 2C, the non-return valves 16–19 may be placed in the flange as shown in FIG. 2B, or in the cylinder head as shown in FIG. 2C. For these cases, other types of valves are more suitable, for example ball valves which would be placed in the channels 12–15. The channels may either be made during the casting of the flange/the manifold or the cylinder head, or be made during the following machining by milling or drilling.

Figure 2D:
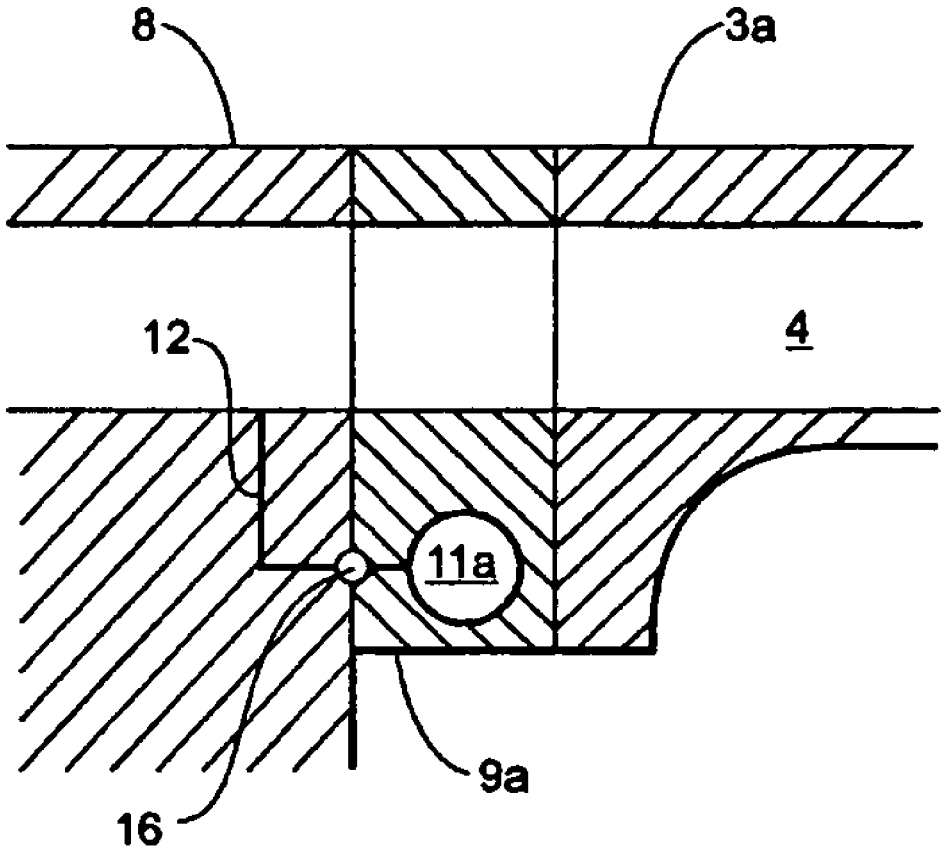

The flange may also be designed as a separate part of the intake manifold, which is disclosed in FIG. 2D. For reasons of production engineering, it may be better to make the intake manifold separately, for example to avoid the casting becoming too complicated. A separate flange 9*a* equipped with a gallery channel 11 may then be mounted between the intake manifold 3*a* and the cylinder head 8. The positioning of the non-return valves may be carried out in the same way as described in connection with FIGS. 2A–2C, where said valves are connected to the part of the intake manifold 3*a* that faces the cylinder head 8 via the outlet channels 12–15.

Figure 2E:
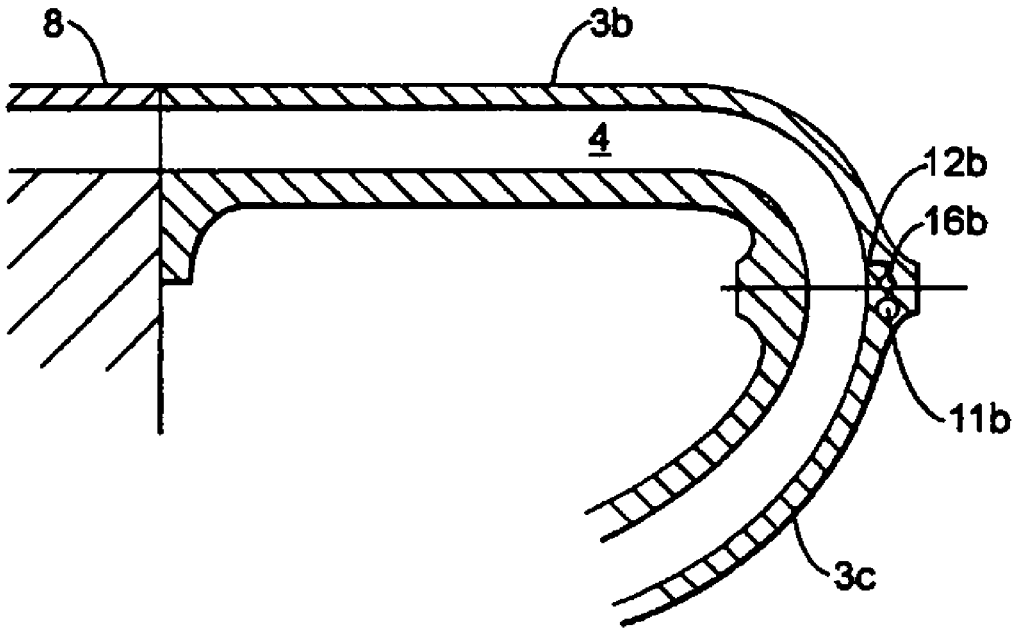

For reasons stated above, it may sometimes be necessary to split the intake manifold, which is shown in FIG. 2E. It is then possible, as described above, to place the gallery channel 11*b* with its associated non-return valves (only 16*b* is shown) in the joint between the halves of the manifold 3*b*, 3*c*.

Figure 2F:
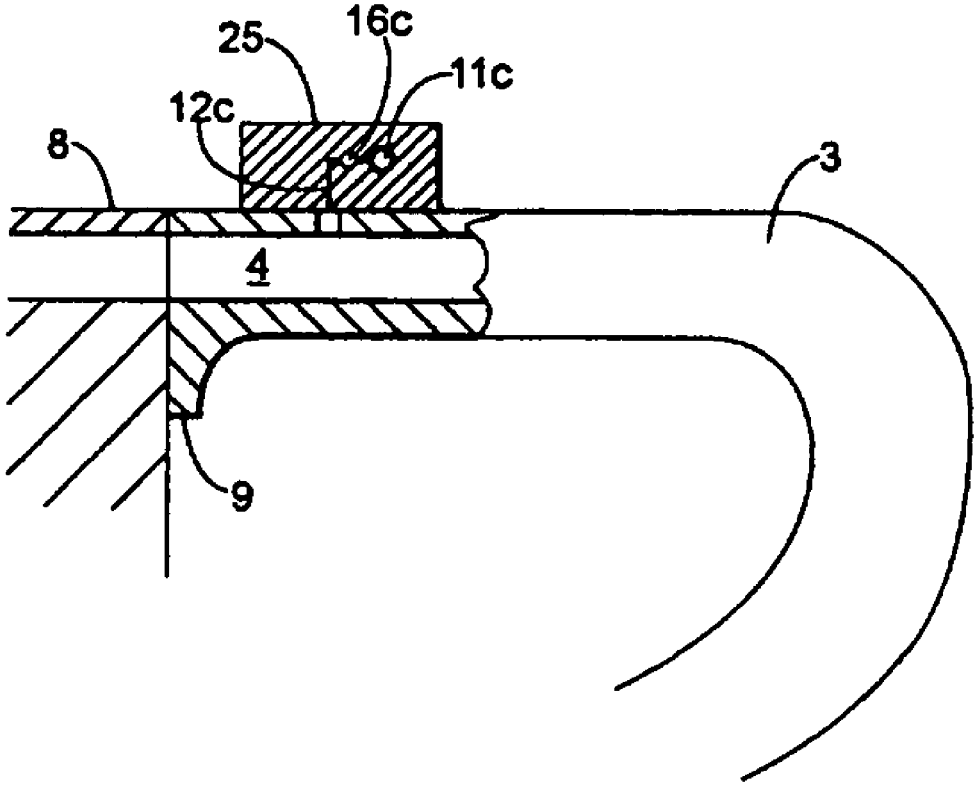

As shown in FIG. 2F, it is also possible to connect a separate unit 25 to the intake manifold 3, which extends across the manifold and includes a gallery channel 11*c* with associated non-return valves (only 16*c* is shown) connected to respective pipe 4–7 via the outlet channels (only 12*c* is shown).

Figure 5:
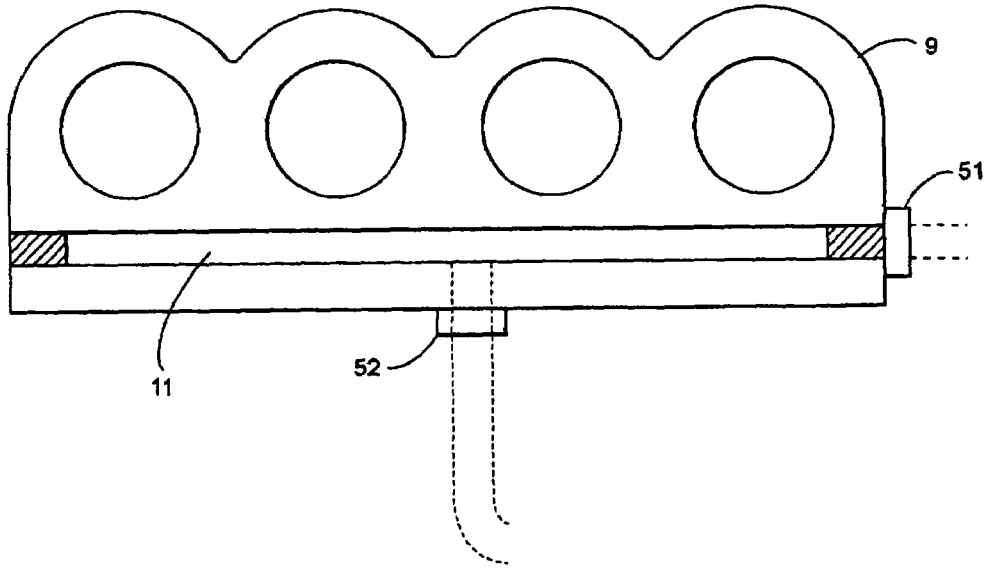
FIG. 5 is a schematic view in partial cutaway and partial section showing alternative connections for supply of ventilated gases to the gallery channel.
Figure 6A:
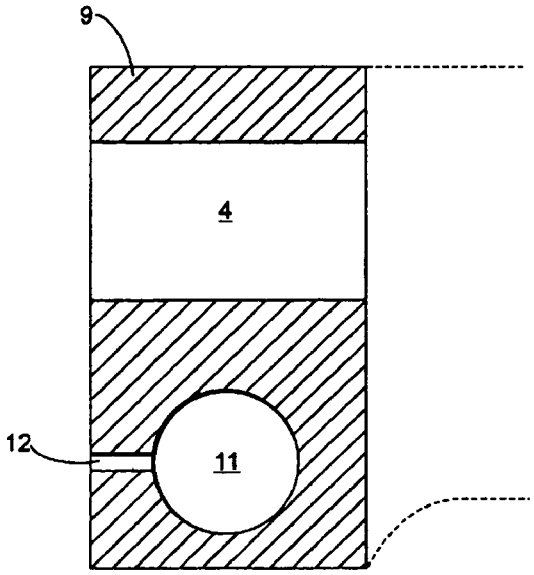
FIG. 6A-C is a cross-sectional view of alternative embodiments of gallery channels made in the flange of the intake manifold.
Figure 6B:
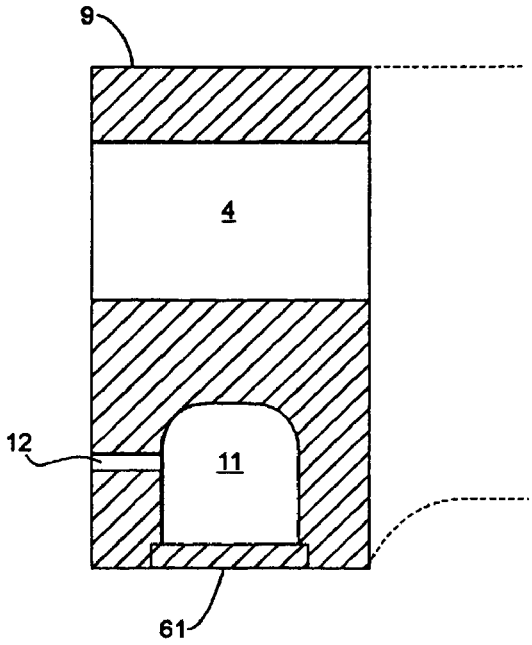
Figure 6C:
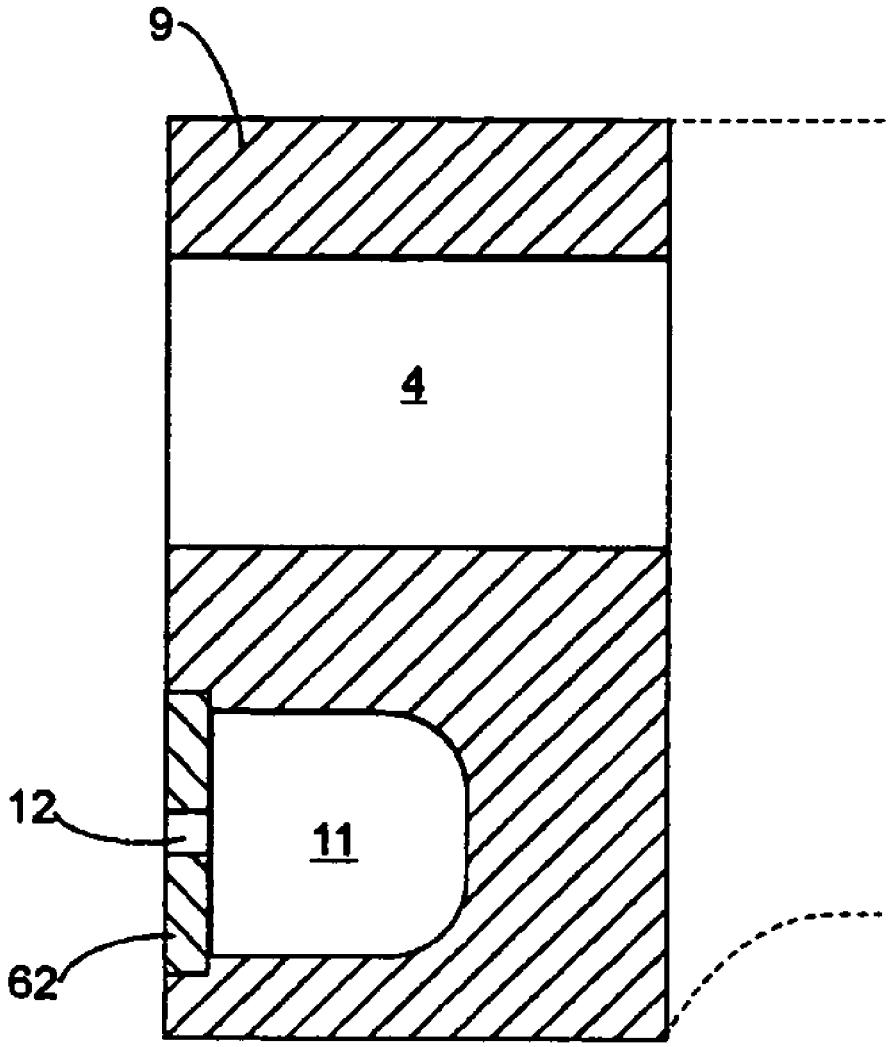
Figure 10A:
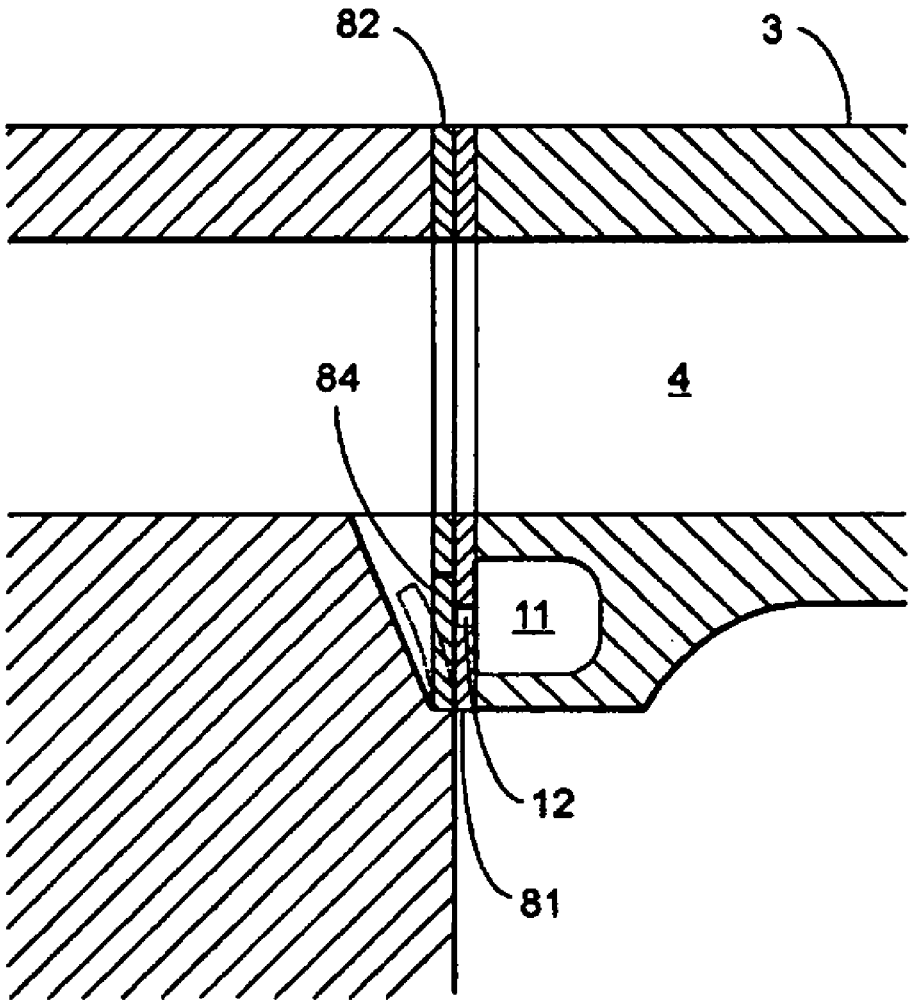
FIG. 10A a sectional view of an embodiment of the invention with a reed valve integrated into a double steel gasket.

The gallery channel 11 may consist of a through bore, which is shown in FIG. 5, where one or both ends are sealed. The connection for ventilated gases may be led into the gallery channel 11 via a conduit which extends to an opening that is not sealed, or be connected to a separately drilled opening 52. The alternatives are shown with dashed lines in FIG. 5. According to another embodiment, which is disclosed in FIG. 6A, the gallery channel may consist of a cavity which is made during the casting of the flange 9, 9*a*, 9*b*, either as a separate component or as a part of the intake manifold. The gallery channel may alternatively be milled as a recess in a part of the flange 9, 9*a*, 9*b*. FIG. 6B shows a recess milled in the lower part of the flange, which has been equipped with a covering lid 61 to form the channel 11. Both embodiments according to FIGS. 6A and 6B must be equipped with a drilled or otherwise machined outlet channel 12. FIG. 6C shows a recess that is milled or cast in the side of the flange 9 that faces the cylinder head 8. The recess is sealed with a gasket 62, in which a hole for the outlet channel 12 is made, to form a gallery channel 11. This gasket 62 may also be designed in combination with the manifold gasket (not shown) that normally is placed between the intake manifold and the cylinder head to form a so-called double steel gasket as is illustrated in FIG. 10A.

Figure 7A:
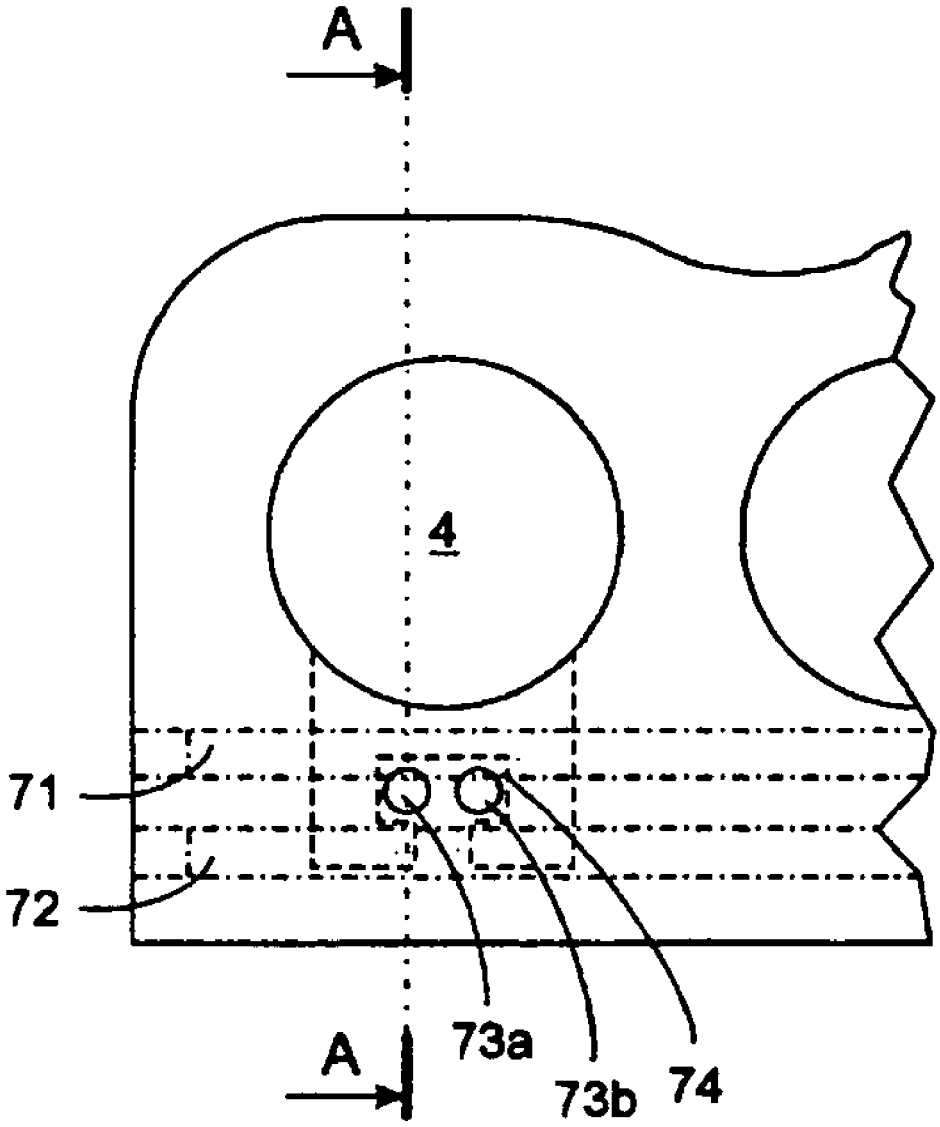
FIG. 7A-B are schematic views, shown in partial cut away and section, of an embodiment having double gallery channels with a reed valve for both outlet channels.
Figure 7B:
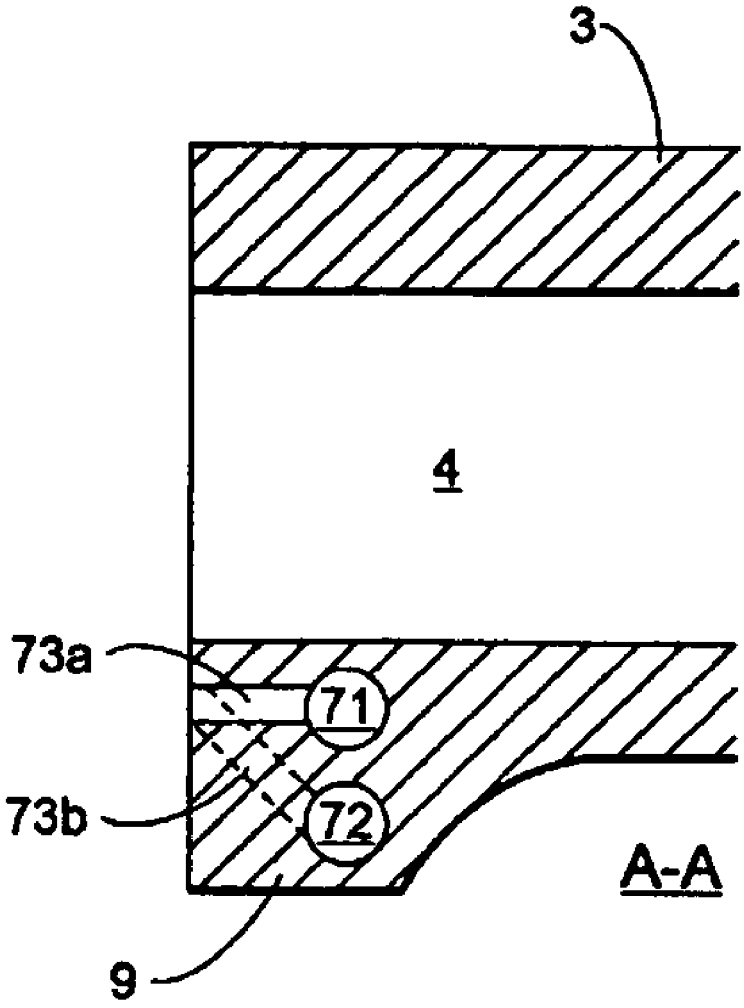

FIGS. 7–9 show different ways to ventilate both crankcase gases and various evaporated gases, as well as re-circulated gases (EGR). To avoid the problems with coatings which are deposited if crankcase gases and EGR are mixed, it is preferable to supply these gases close to the intake valve. As shown in FIGS. 7A and 7B, this may be achieved with the help of separate gallery channels 71, 72 and outlet channels 73*a*, 73*b* arranged in the flange. Each channel may be provided with non-return valves (not shown) as described above using either a valve per channel or a reed valve 74 (FIG. 7A, dashed lines) that covers both openings (see FIG. 3).

Figure 8A:
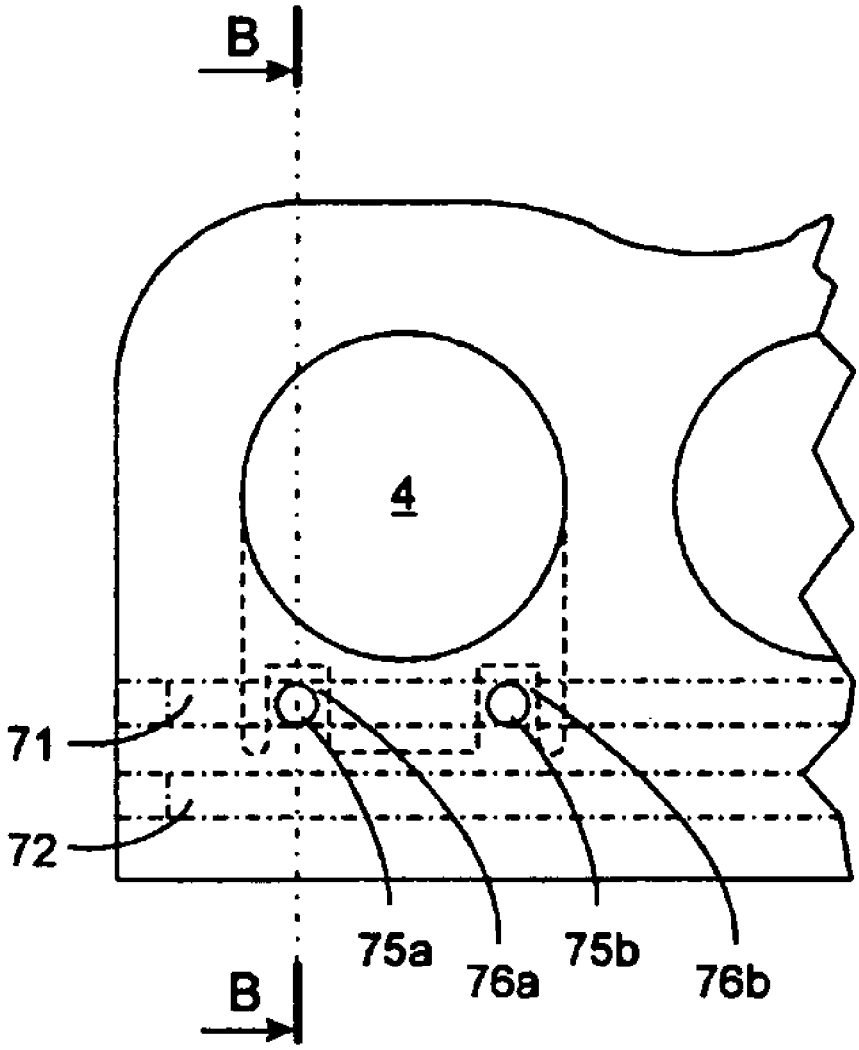
FIG. 8A-B are schematic views, shown in partial cut away and section, of an embodiment having double gallery channels with a reed valve for each outlet channel.
Figure 8B:
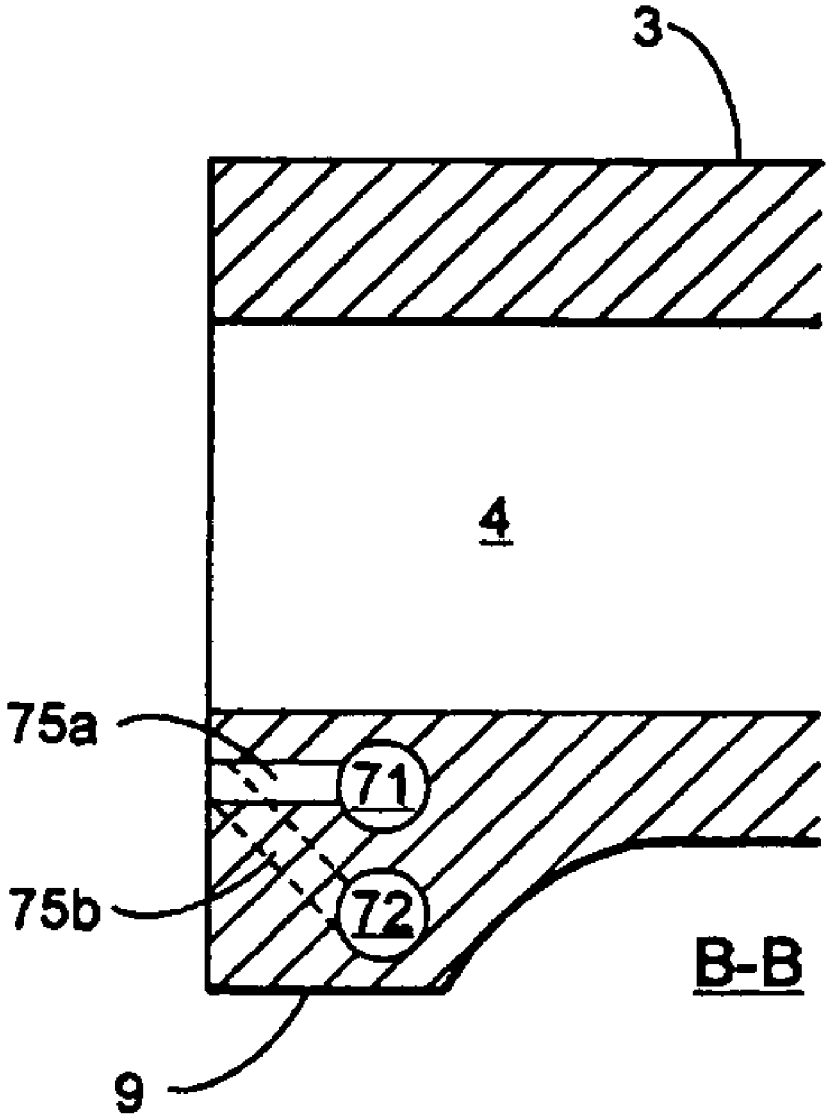

Alternatively, the outlet channels 75*a*, 75*b* may be placed at a distance from each other, according to FIGS. 8A and 8B, to further reduce the possibility of the mixing of gases taking place. If reed valves are to be used in this case, a valve 76*a*, 76*b* (FIG. 8A, dashed lines) is needed for each opening.

Figure 9A:
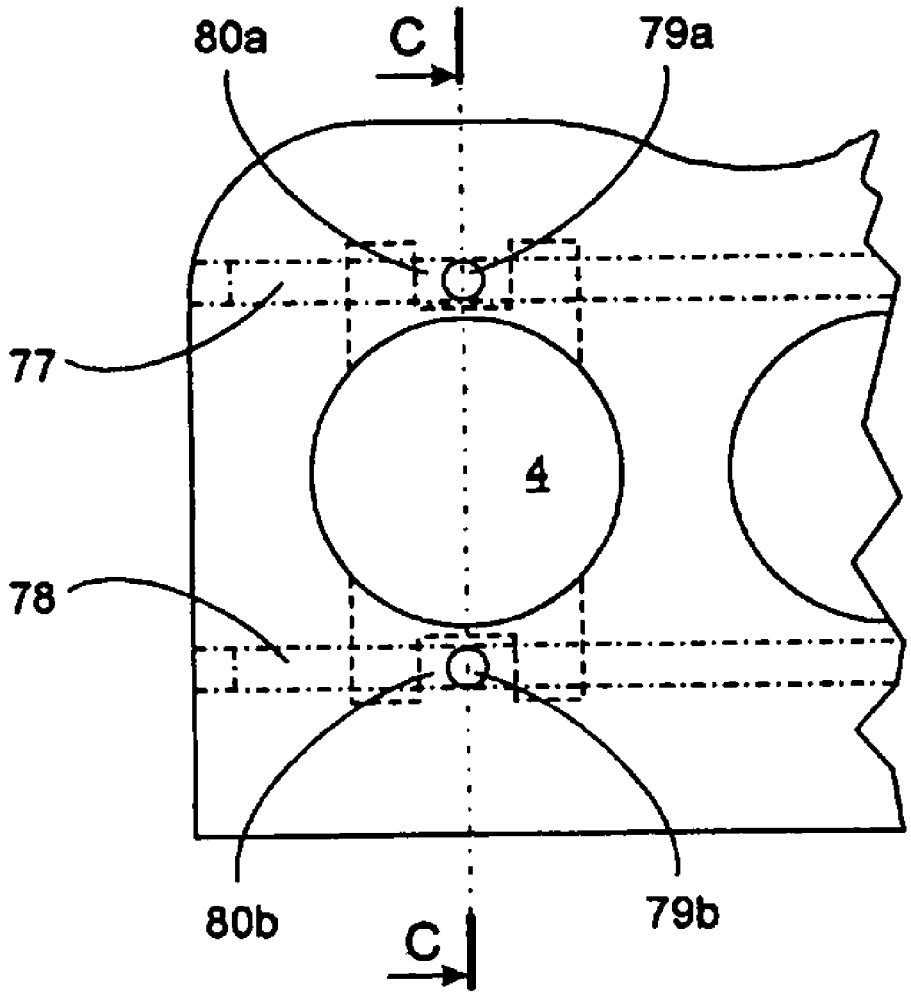
FIG. 9A-B are schematic views, shown in partial cut away and section, of an embodiment having double, separated gallery channels with a reed valve for each outlet channel.
Figure 9B:
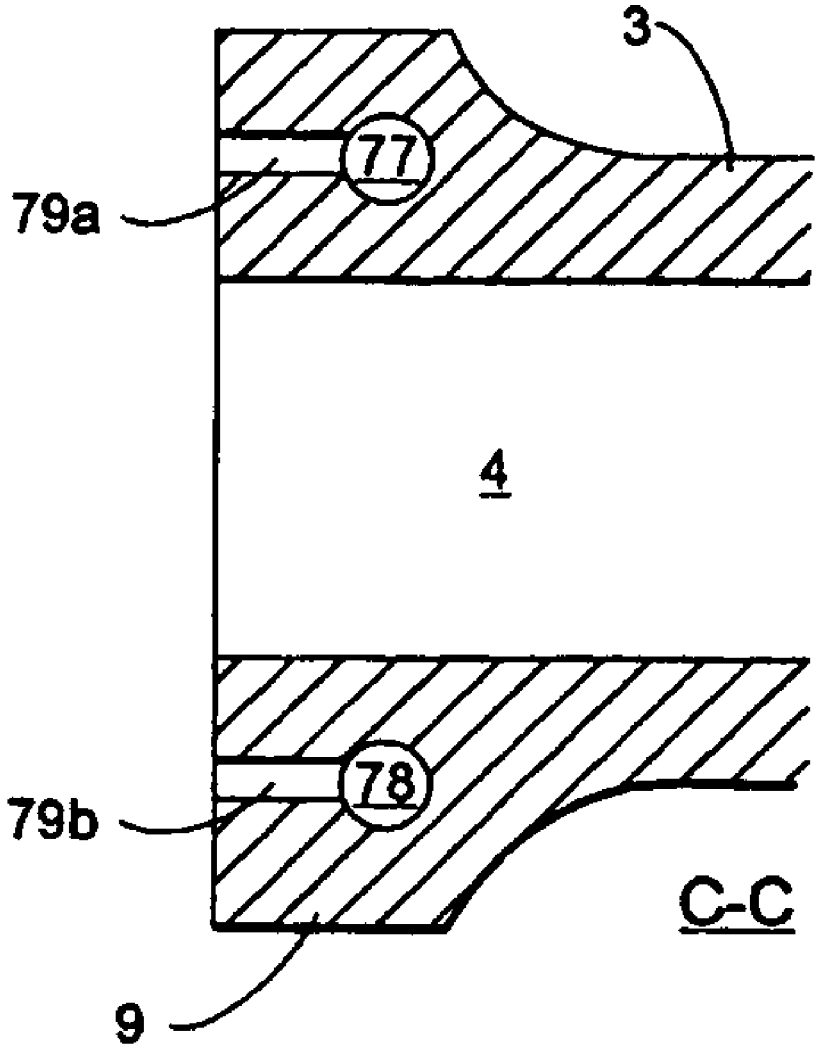

A third embodiment is shown in FIGS. 9A and 9B where a pair of gallery channels 77 and 78 are shown to have been respectively placed above and below the nozzle 4 and to have been equipped with upper and lower outlet channels 79*a* and 79*b*. As indicated above, both ordinary non-return valves and reed valves may be used. When using reed valves, the gasket then has to be provided with corresponding tongues 80*a* and 80*b* respectively (FIG. 9A, dashed lines) in connection with the openings of both outlet channels 79*a* and 79*b*, respectively. The embodiments according to FIG. 7-9 are shown with the flange 9 and the intake manifold 3 made in one piece. It is of course possible to make the flange as a separate part, according to the embodiment described in connection with FIG. 2D hereinabove.

It is also possible to add crankcase gases, EGR and similar mixtures at separate positions by means of a double set of components provided with gallery channels. Adding EGR to a split intake manifold (according to FIG. 2E, or alternatively to a unit according to FIG. 2E) at the same time that the crankcase gases are led to the connection of the manifold to the cylinder head makes it possible to keep the gases separated from each other as long as possible. Other variations are of course possible, as long as EGR is added to the manifold before, or earliest at the same time as, the crankcase gases. Otherwise there is a risk that the components in the system, such as pipes and non-return valves, will receive a bitumen-like coating.

FIG. 10A shows a gallery channel 11 made as a recess in the flange 9, which recess is sealed with a first gasket 71 which extends across all of the end surface of the flange and is equipped with an outlet channel 12. A second gasket 72 with the same extent relative to the flange is riveted or in some other way fastened to the first gasket 71. The gasket 72 is also provided with a reed valve which opens towards the intake manifold. This package of gaskets 71, 72 forms a double steel gasket, which then constitutes the manifold gasket between the intake manifold and the cylinder head.

Figure 10B:
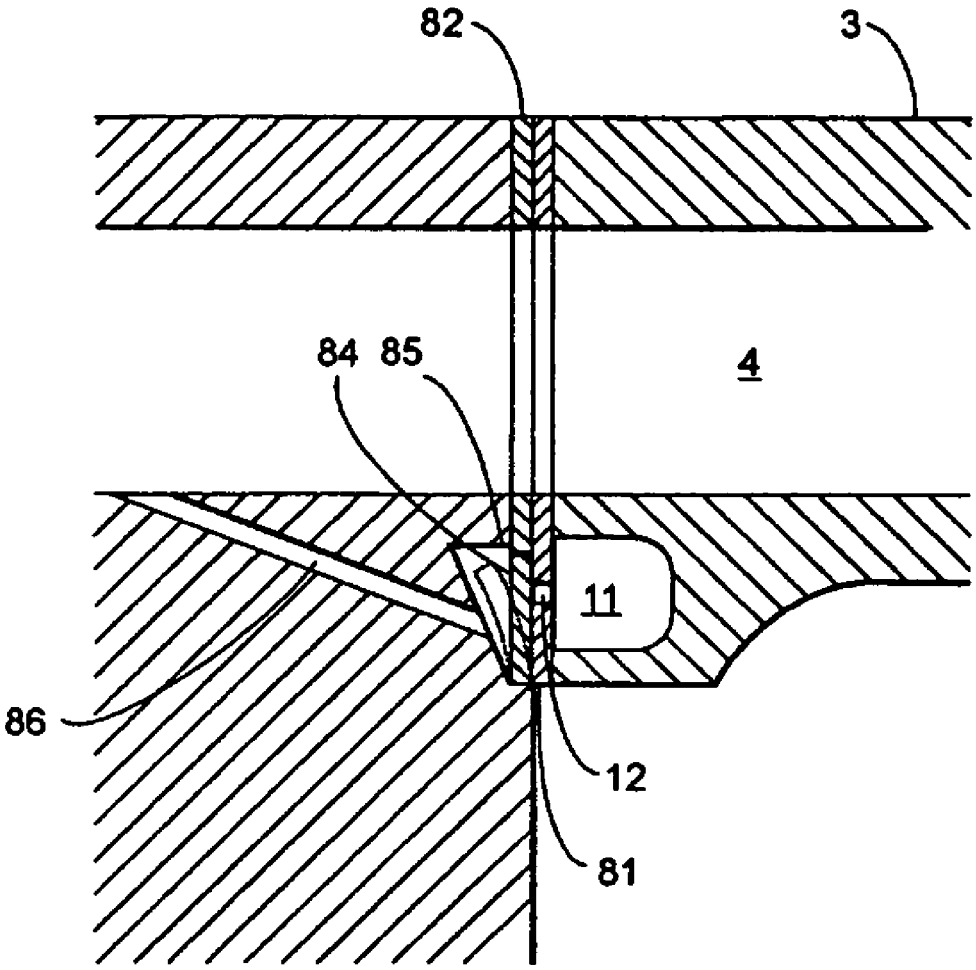
FIG. 10B a sectional view of an embodiment of the invention with an encased reed valve.

An alternative embodiment of the invention which has been described with reference to FIG. 10A is disclosed in FIG. 10B. This embodiment describes an enclosed reed valve, which is connected to the intake manifold 4 via a chamber 75 and an outlet channel 76 that emerges a short distance downstream of the connection of the manifold to the cylinder head. The chamber 75 is formed by a recess in the cylinder head, which is de-limited by the double-steel gasket 71,72 and allows the resilient tongue (dashed line) of the reed valve 74 to deflect outwards. In this way it is possible to avoid fuel flowing down into the valve and disturbing its function. This problem may arise in connection with wetting of the walls of the inlet channel during certain operating conditions.

Except non-return valves of standard type or reed valves, it is also possible to use electrically controlled valves, for example solenoid valves. The valves are controlled by the electronic engine control and are made to open at predetermined or mapped points in time for each solenoid. At the points in time in question, the pressure is lower at the position of the solenoid valve than in other parts of the intake manifold. The points of time may be mapped by measuring and/or calculation of the pressure changes in the intake manifold at different operating conditions.

What is claimed is:

1. An arrangement for distributing ventilated gases in a combustion engine, the arrangement comprising:

a cylinder head, and an intake manifold having a flange for mounting on the cylinder head, the intake manifold further comprising at least one collecting channel extending across each intake pipe of the intake manifold, wherein the at least one collecting channel is connected to one of:

each intake pipe of the intake manifold; or each intake pipe of the cylinder head;

via outlet channels having separate non-return valves, wherein the non-return valves are outside the intake manifold, and a gasket between the flange and the cylinder head wherein the non-return valves are further comprised at least in part of the gasket.

2. The arrangement according to claim 1, further comprising at least one opening emerging from the collecting channel and membranes forming the non-return valves wherein the membranes are resiliently and sealingly arranged against the at least one opening.

3. The arrangement according to claim 2, wherein each of the membranes is formed in one piece with the gasket.

4. The arrangement according to claim 3, wherein the gasket further comprises a first steel gasket having the membranes in contact with the cylinder head and a second steel gasket in contact with the intake manifold and attached to the first gasket.

5. The arrangement according to claim 2, wherein the gasket further comprises steel.

6. The arrangement according to claim 2, wherein the gasket further comprises fiber material.

* * * * *

UNITED STATES PATENT AND TRADEMARK OFFICE

CERTIFICATE OF CORRECTION

PATENT NO. : 6,966,310 B2
DATED : November 22, 2005
INVENTOR(S) : Moren

It is certified that error appears in the above-identified patent and that said Letters Patent is hereby corrected as shown below:

Title page,
Item [73], Assignee, change "Gothenburg" to -- Göteborg --.

Signed and Sealed this

Fourth Day of April, 2006

JON W. DUDAS
*Director of the United States Patent and Trademark Office*

UNITED STATES PATENT AND TRADEMARK OFFICE

CERTIFICATE OF CORRECTION

PATENT NO. : 6,966,310 B2
APPLICATION NO. : 09/681596
DATED : November 22, 2005
INVENTOR(S) : Moren It is certified that error appears in the above-identified patent and that said Letters Patent is hereby corrected as shown below:

On the Title page:
Item (73) Assignee, Change "Göteborg" to --Göteburg--.

Signed and Sealed this

Eleventh Day of July, 2006

JON W. DUDAS
*Director of the United States Patent and Trademark Office*